US010957957B2

(12) United States Patent
So et al.

(10) Patent No.: US 10,957,957 B2
(45) Date of Patent: Mar. 23, 2021

(54) PHASE SHIFTER INCLUDING A GUIDE UNIT WITH A GUIDE ROLLER WHICH MOVES MOVABLE BOARDS RELATIVE TO FIXED BOARDS

(71) Applicant: KMW INC., Hwaseong-si (KR)

(72) Inventors: Sung-hwan So, Hwaseong-si (KR); Seong-man Kang, Hwaseong-si (KR); Eun-suk Jung, Hwaseong-si (KR); Dae-myung Park, Hwaseong-si (KR); Sang-hun Lee, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 59 days.

(21) Appl. No.: 16/050,216

(22) Filed: Jul. 31, 2018

(65) Prior Publication Data

US 2018/0337438 A1 Nov. 22, 2018

Related U.S. Application Data

(63) Continuation of application No. PCT/KR2017/001085, filed on Feb. 1, 2017.

(30) Foreign Application Priority Data

Feb. 3, 2016 (KR) ..... 10-2016-0013629

(51) Int. Cl.
*H01P 1/18* (2006.01)
*H01Q 3/32* (2006.01)
(Continued)

(52) U.S. Cl.
CPC ..... *H01P 1/184* (2013.01); *H01P 3/08* (2013.01); *H01Q 3/32* (2013.01); *H01Q 5/20* (2015.01); *H01Q 1/246* (2013.01)

(58) Field of Classification Search
CPC ..... H01P 1/184; H01P 1/18; H01P 9/00
(Continued)

(56) References Cited

U.S. PATENT DOCUMENTS 6,512,426 B1 * 1/2003 Wixforth ..... H01P 1/184 333/99 S
2003/0016097 A1 * 1/2003 McKinzie, III et al. ..... H01Q 3/2682 333/161
(Continued)

FOREIGN PATENT DOCUMENTS

GB 2426635 A 11/2006
JP 60-001848 A 1/1985
(Continued)

OTHER PUBLICATIONS

Extended Search Report dated Sep. 10, 2019 for European Application No. 17747725.4.
(Continued)

*Primary Examiner* — Benny T Lee

(57) ABSTRACT

A phase shifter according to at least one embodiment of the present disclosure has a housing provided on both surfaces with respective shifting units. Each shifting unit is composed of a fixed board and a moving board. Movement of the moving board causes a phase-shifted signal to be simultaneously transferred from both surfaces of the housing to output ports. This allows more effective use of the space of the phase shifter and therearound.

11 Claims, 12 Drawing Sheets

(51) Int. Cl.
*H01Q 5/20* (2015.01)
*H01P 3/08* (2006.01)
*H01Q 1/24* (2006.01)

(58) Field of Classification Search
USPC ..... 333/161
See application file for complete search history.

(56) References Cited

U.S. PATENT DOCUMENTS

| | | | | |
|---|---|---|---|---|
| 2004/0246175 | A1 | 12/2004 | Thomas | |
| 2005/0248494 | A1 | 11/2005 | Davies | |
| 2016/0372809 | A1* | 12/2016 | Liu et al. ..... | H01P 1/182 |

FOREIGN PATENT DOCUMENTS

| | | | |
|---|---|---|---|
| JP | 11-205002 | A | 7/1999 |
| JP | 2001-237603 | A | 8/2001 |
| JP | 2002-033603 | A | 1/2002 |
| JP | 2009-147442 | A | 7/2009 |
| JP | 2012-526447 | A | 10/2012 |
| KR | 10-2010-0122005 | A | 11/2010 |

OTHER PUBLICATIONS

Office Action dated Aug. 20, 2019 for Japanese Application No. 2018-539845.
Chinese office action dated Apr. 14, 2020 for Chinese Application No. 201780009690.9 and its English translation.

* cited by examiner

*PRIOR ART*

*PRIOR ART*

PHASE SHIFTER INCLUDING A GUIDE UNIT WITH A GUIDE ROLLER WHICH MOVES MOVABLE BOARDS RELATIVE TO FIXED BOARDS

CROSS-REFERENCE TO RELATED APPLICATION

The present application is a continuation of International Patent Application No. PCT/KR2017/001085 filed Feb. 1, 2017, entitled "PHASE SHIFTING DEVICE," which claims priority under 35 U.S.C. § 365 and/or 35 U.S.C. § 119(a) to Korean Patent Application No. 10-2016-0013629 filed Feb. 3, 2016. The full disclosures of the above-listed applications are hereby incorporated by reference.

TECHNICAL FIELD

The present disclosure in some embodiments relates to a phase shifter.

BACKGROUND

The statements in this section merely provide background information related to the present disclosure and do not necessarily constitute prior art.

Antennas when radiating a horizontal beam, could exhibit the maximum effective coverage, but signal interference or loss exacts designing the antennas with a predetermined tilt, e.g., a 5° down tilt. Mechanical downward tilting of an antenna is burdensome because it requires installers to visit the site and switch the antenna off during the repositioning. Accordingly, methods have been introduced to electrically alter the tilt of the radiating beam by providing the radiating elements in an array with phase changes induced along the length of the array corresponding to tilts of various angles, which is carried out by a phase shifting device. Respective phase shifting devices receive a signal at a common input port, and transmit the same via a plurality of output ports to the radiating elements installed in an antenna.

The applicant has proposed in Korean registered patent No. 101567882, an example of an electrical phase shifting device as shown in FIG. 1A. The phase shifting device includes a fixed board 14' having a circuit pattern 114' for connecting between an input port IN and five output ports P1, P2, P3, P4 and P5. The phase shifting device further includes a moving board 12' having a sub-board 124' formed with a variable strip 126'. The fixed board 14' is typically made of a printed circuit board.

When the moving board 12' reciprocates in the vertical direction in the drawing, the contact length between the variable strip 126' and the circuit pattern 114' changes to generate variable capacitive coupling between the transmission lines, which in turn changes the phase of the signal transmitted to each output port. Letter "d" represents the range of moving distance of the moving board.

As shown in FIG. 1B, a moving mechanism was provided in the moving board by incorporating a plurality of convex portions 144' of a plastic material to serve as a clearance spacer so that the moving board and its housing 10' are in slidable contact with each other.

Another background art example is U.S. Patent Application Publication No. US 2005/0248494 A1 which discloses, as shown in FIG. 2A, a fixed board 14' having an input port IN' and five output ports a', b', c', d' and e', each corresponding to five pairs of antenna elements 1,2; 3,4; 5,6; 7,8; and 9,10, and a slider circuit or moving board 12' with phase-varying strips. The fixed board 14' has circuit patterns formed to be symmetrical about the central axis thereof, and the moving board 12' correspondingly has paired phase-varying strips arranged in a total of four rows. The symmetrical circuit patterns are employed in a dual polar antenna array wherein the respective output ports are connected to two duplicate sets of antenna elements, operated on opposite polarizations.

The prior art moving mechanism involves, as shown in FIG. 2B, a moving board/block/actuator arm assembly indicated by 12' mounted on the fixed board 14' in a slidable manner responsive to an operation of the actuator arm. The slidable mounting is provided by bolts 18' screwed through openings in the fixed board 14' and extending through slots 16' in the actuator arm to define linear travel for the moving board 12'.

The background art described above employs a structure in which a fixed board 14' and a moving board 12' are installed only on one side of the phase shift device. In addition, the prior art moving mechanisms are susceptible to a shortened service life and aged deterioration in that the prior art moving mechanisms get reduced durability due to repetitive friction of the convex portion 144' (FIG. 1B), or that the prior art moving mechanisms suffer from limited travel range for the moving board 12' due to the limited elongation of the slots 16' (FIG. 2B) and suffer from worning out slots 16' over a long-term use.

Recently, antennas, widely used in base stations and repeaters of mobile communication systems, are required to meet the needs for a multi-band frequency capability to provide services of various frequency bands and even miniaturization as well as lightening of weight, for which various researches are being conducted. Multi-band frequency antennas are required to adjust the phase of frequencies across different frequency bands individually. This, however, needs a sizable number of phase shift devices which adversely involves spatial restrictions on antenna designs.

The approach to assign the phase shift devices more interior space of an antenna leads to more crowded antenna elements in a tight space allowance, which raises practical implementation issues of dimensional and configuration restrictions on the antenna elements.

Currently, excluding the minimum required space for phase shifting devices, the remaining space in an antenna is used for the element section, further increasing the antenna size undesirably.

DISCLOSURE

Technical Problem

Accordingly, the present disclosure in some embodiments seeks to provide a phase shifter having a new structure which can enhance use of the space of an antenna device.

The present disclosure in another embodiment seeks to provide a guide unit which can easily lead the phase shifting drive of the phase shifter.

SUMMARY OF THE INVENTION

At least one aspect of the present disclosure provides a phase shifter including a housing, a first shifting unit and a second shifting unit. The housing has a first surface and a second surface. The first shifting unit is configured to be disposed on the first surface of the housing, and to include a first fixed board formed with a first circuit pattern, and a first moving board formed with a first conductive strip that is coupled to the first circuit pattern of the first fixed unit. The second shifting unit is configured to be disposed on the second surface of the housing, and to include a second fixed board formed with a second circuit pattern, and a second moving board formed with a second conductive strip that is coupled to the second circuit pattern of the second fixed unit.

Another aspect of the present disclosure provides an antenna device including a guide configured to be linked with the phase shifter, and an actuator configured to linearly move the guide, and a driving source configured to drive the actuator.

Yet another aspect of the present disclosure provides a communication apparatus including the phase shifter.

Advantageous Effects

According to some embodiments of the present disclosure, in a multi-band antenna which needs to individually adjust the phases of frequencies of multiple bands, the number of phase shifters can be reduced to thereby address the spatial restriction issue.

Furthermore, the present disclosure is advantageous in terms of downsizing and weight reduction of the antenna device, and can provide a compact antenna device with an increased usable space.

Further, according to some embodiments of the present disclosure, rotation of a guide roller provides a smooth guided movement of a board, and a inclined surface contact prevents the wear of parts and improves the durability of the phase shifter.

The above is example effects of illustrative embodiments of the present disclosure, and other effects of the present disclosure will become clearer from the technology of some embodiments described below.

DETAILED DESCRIPTION OF THE INVENTION

Figure 1A:
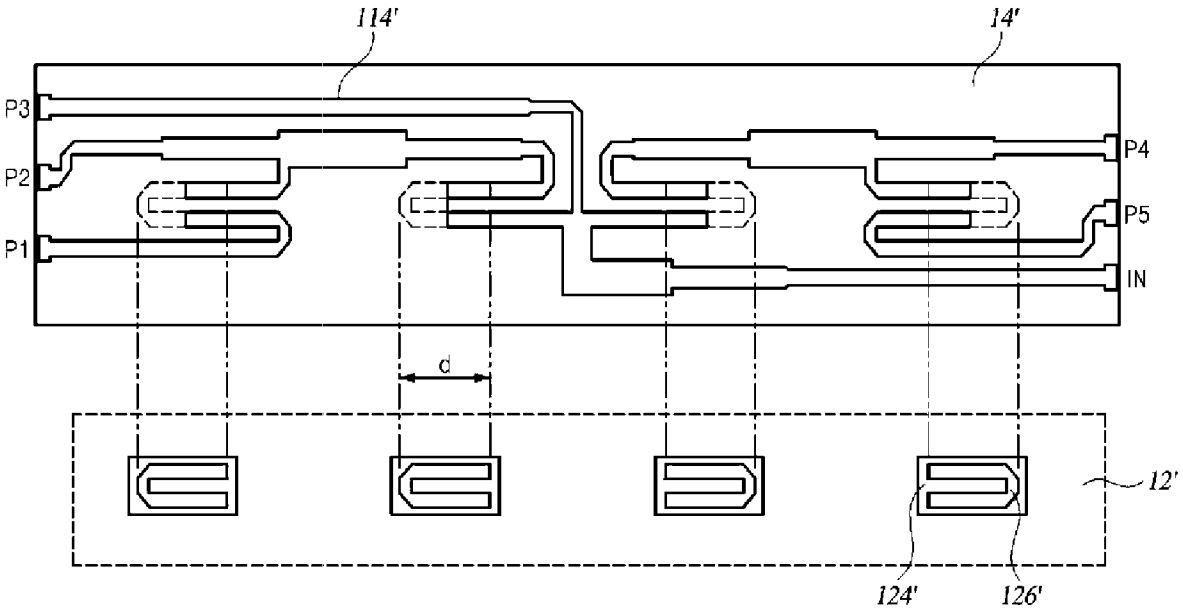
FIG. 1A PRIOR ART
FIG. 1A is a plan view of a conventional set of a fixed board and a moving board.
Figure 1B:
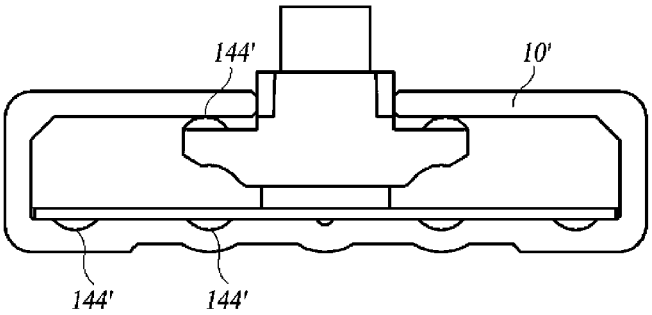
FIG. 1B is a side view of a moving structure of a phase shifter shown in FIG. 1A.
Figure 2A:
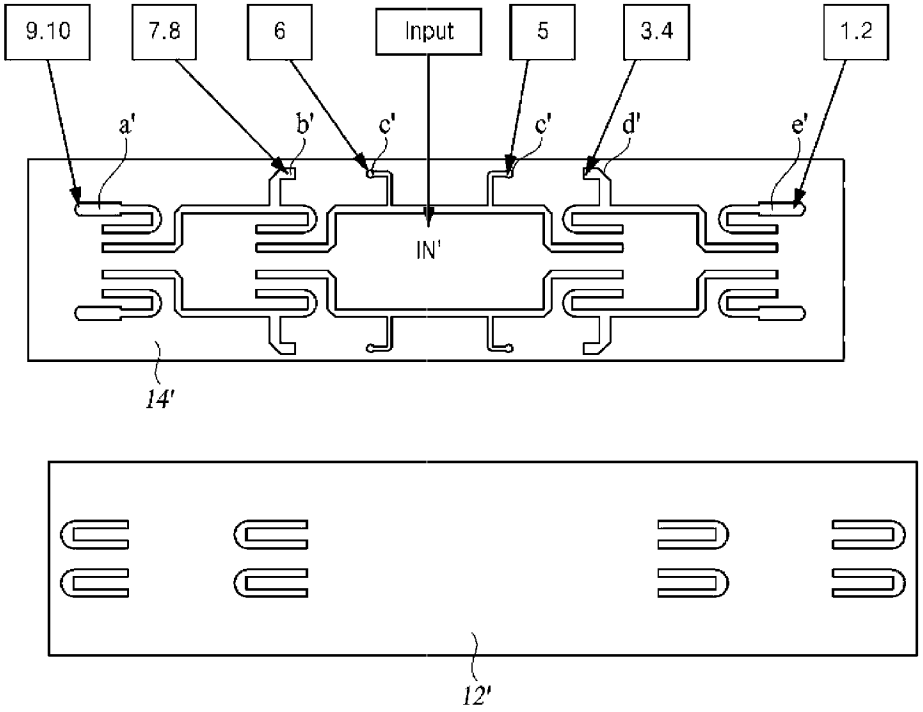
FIG. 2A PRIOR ART
FIG. 2A is a plan view of another conventional set of a fixed board and a moving board.
Figure 2B:
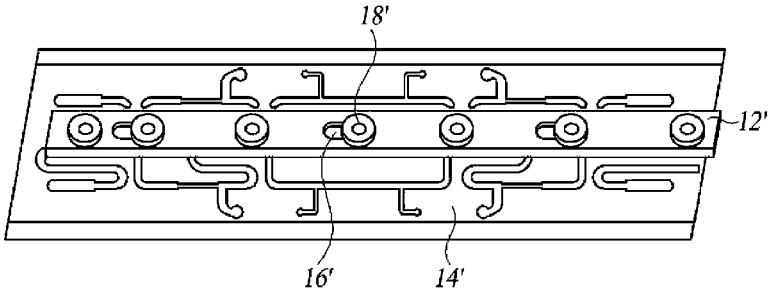
FIG. 2B is a perspective view of a moving structure of a phase shifting device of FIG. 2A.

Hereinafter, some embodiments of the present disclosure will be described in detail with reference to the accompanying drawings. In the following description, like reference numerals designate like elements, although the elements are shown in different drawings. Further, in the following description of some embodiments, a detailed description of known functions and configurations incorporated therein will be omitted for the purpose of clarity and for brevity.

Additionally, various terms such as "first", "second", "A", "B", "(a)", "(b)", etc., are used solely for the purpose of differentiating one component from the other, not to imply or suggest the substances, the order or sequence of the components. Throughout this specification, when a part "includes" or "comprises" a component, the part is meant to further include other components, not excluding thereof unless specifically stated to the contrary. The terms such as "unit," "module," and the like refer to units for processing at least one function or operation, which may be implemented by hardware, software, or a combination thereof.

Hereinafter, a phase shifter according to at least some embodiments of the present disclosure will be described with reference to the accompanying drawings. The phase shifter of at least some embodiments roughly includes a first shifting unit including a first fixed board and a first moving board, a second shifting unit including a second moving board and a second fixed board, and a housing on which the boards are mounted.

Figure 3:
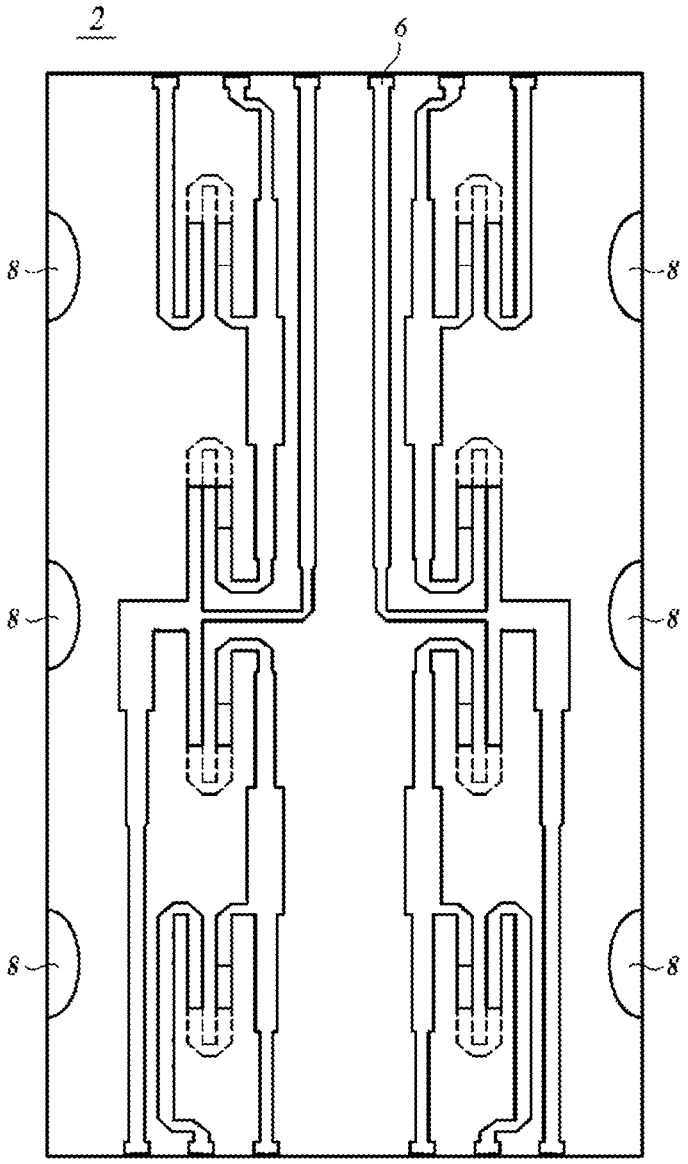
FIG. 3 is a plan view of a fixed board of a phase shifter according to at least some embodiments of the present disclosure.
Figure 4:
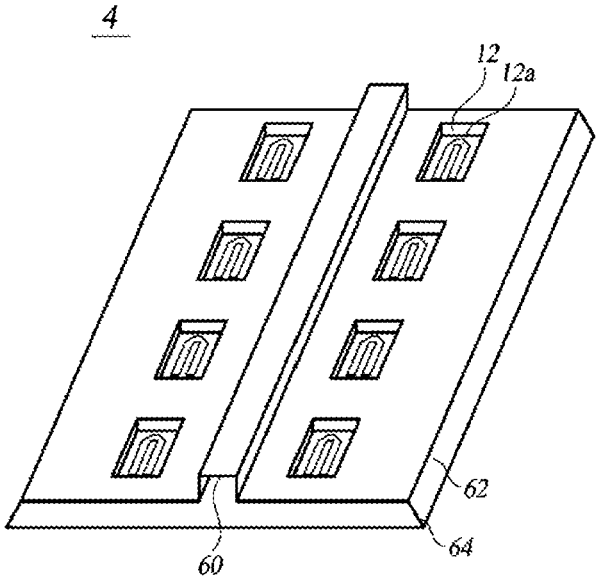
FIG. 4 is a perspective view of a moving board of the phase shifter according to at least some embodiments of the present disclosure.

As shown in FIGS. 3 and 4, a first shifting unit includes a first fixed board 2 (FIG. 3) and a first moving board 4 (FIG. 4) according to at least some embodiments. The first fixed board 2 (FIG. 3) and the first moving board 4 (FIG. 4) form a first shifting unit of at least some embodiments.

The first fixed board 2 (FIG. 3) is made of a rectangular printed circuit board having one long axis. On the upper surface of the first fixed board 2 (FIG. 3), a first circuit pattern 6 (FIG. 3) is formed by a method such as etching or the like. The first circuit pattern 6 (FIG. 3) is formed symmetrically about the longitudinal central axis of the fixed board 2 (FIG. 3) and is suitable for a dual antenna arrangement. The first circuit pattern 6 (FIG. 3) is merely an example, and other symmetrical or asymmetric patterns may be duly formed according to the antenna specifications.

Three recessed grooves 8 (FIG. 3) are formed along both lateral sides of the first fixed board 2 (FIG. 3), respectively. The recessed grooves 8 (FIG. 3) have a predetermined shape that opens outward, and they are arranged at a predetermined pitch longitudinally of the first fixed board 2 (FIG. 3). The recessed groove 8 (FIG. 3) is configured to accommodate a rotating shaft of a guide roller for guiding the linear movement of the first moving board 4 (FIG. 4), which will be described below. The shape, size, and the number of recessed grooves 8 (FIG. 3) to be provided for carrying out this function are not limited to those as illustrated herein.

The first moving board 4 (FIG. 4) is fabricated to have a predetermined thickness in a long rectangular shape. The first moving board 4 (FIG. 4) is a member that moves over the first fixed board 2 (FIG. 3), and is desirably formed to have a width and a length slightly smaller than those of the first fixed board 2.

A protrusive rib 60 (FIG. 4) is formed as a stiffener on the first moving board 4 at widthwise central portion of the first moving board 4 along the entire length thereof. In addition, the first moving board 4 (FIG. 4) has both side surfaces 62 (FIG. 4) each provided with an inclined surface 64 (FIG. 4)

tapered toward the outside. This enables the first moving board 4 (FIG. 4) to engage the contact surface of the guide roller, as will be described below.

Sub-boards 12 (FIG. 4) are installed at predetermined positions on the upper surface of the first moving board 4 (FIG. 4). Each sub-board 12 has a conductive strip 12*a* of a predetermined shape such as a U-shape, which is inserted therein and is exposed through the undersurface of the sub-board 12, so as to contact the first circuit pattern 6 of the first fixed board 2 (FIG. 3). The sub-boards 12 have a leaf spring structure with elastic force, and they are arranged symmetrically about the rib 60 so that an array of four sub-boards 12 lies on each side of the rib 60 to match the first circuit pattern 6, although this illustrative arrangement shown is duly modified in concert with modifications of the first circuit pattern 6.

Those skilled in the art know that the fixed board provides a predetermined circuit pattern, while the moving board provides conductive strips that move over the fixed board to be in contact or coupled with the predetermined circuit pattern in order to carry out the function of varying the contact length between the fixed board and the moving board. It should be noted, however, that when engaged in that function, the first fixed board 2 and the first moving board 4 according to at least some embodiments of the present disclosure contemplate not to stop at the aforementioned example but to go beyond the very limitation thereof.

Figure 5:
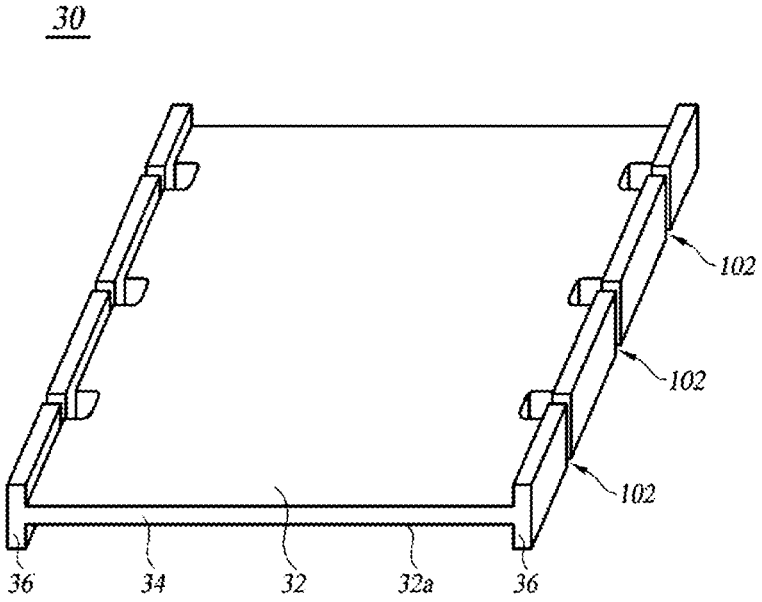
FIG. 5 is a perspective view of a housing of the phase shifter according to according to at least some embodiments of the present disclosure.

The phase shifter 1 (FIG. 6) is provided with a housing 30 according to the embodiment shown in FIG. 5. The housing 30 forms a skeleton or frame of the phase shifter 1, and is a member for housing the fixed board and the moving board.

Figure 6:
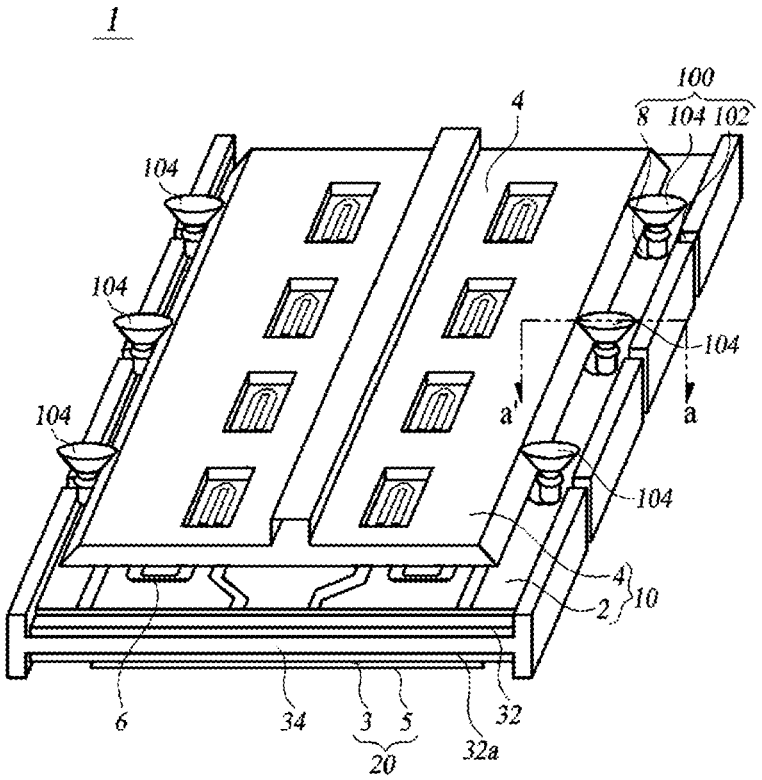
FIG. 6 is an overall perspective view of a phase shifter according to at least some embodiments of the present disclosure.

One of the features of the present disclosure is that the phase shifter 1 (FIG. 6) is provided, on its top and bottom sides respectively, with the first shifting unit 10 formed of the first fixed board 2 (FIG. 6) and the first moving board 4 (FIG. 6), and a second shifting unit 20 (FIG. 6) formed of a second fixed board 3 (FIG. 6) and a second moving board 5 (FIG. 6) having substantially the same or similar structures as the counterparts of the first shifting unit 10 (FIG. 6). Therefore, the housing 30 is shown vertically symmetrical with respect to the center line in the thickness direction.

The housing 30 is an H-shaped frame having a transversely extending web when viewed from the front, and has a body 34 and a pair of upright side walls 36 erected from both ends of the body 34.

The body 34 is planar which provides space enough to accommodate the first fixed board 2 and the second fixed board 3. The body 34 has a top surface 32 and a bottom surface 32*a* installed with the first shifting unit 10 and the second shifting unit 20, respectively. In the housing 30 according to some embodiments of the present disclosure, the top surface 32 forms a first surface and the bottom surface 32*a* forms a second surface.

The body 34 is made of a material taking account of heat radiation of the printed circuit board. The material used may be an alloy containing aluminum, boron, quartz or vitreous quartz or ceramics or plastics such as nylon including polyphthalamide (PPA) or mixtures thereof, which have high heat resistance.

The side walls 36 correspond to longitudinally extending flanges, and extend upwardly integrally with the body 34 so as to cover the entire side surfaces of the housing 30. In the illustrated example, each side wall 36 is divided into four separate walls, and side wall guides 102 are provided between the separate walls.

FIG. 6 is a top perspective view of the phase shifter 1 according to the embodiment described above, wherein the housing 30 (FIG. 5) has the first fixed board 2 and the first moving board 4 attached to the top surface 32 thereof, and the second fixed board 3 and the second moving board 5 attached to the bottom surface 32*a* thereof. The first fixed board 2 and the first moving board 4 on the top surface 32 of the housing 30 (FIG. 5) constitute the first shifting unit 10, and the second fixed board 3 and the second moving board 5 on the bottom surface 32*a* constitute the second shifting unit 20. In at least some embodiments of the present disclosure, the configuration and structure of the second shifting unit 20 is substantially the same as that of the first shifting unit 10. In the following description, a repeated description of the bottom structure of the phase shifter 1 will be omitted to avoid redundancy.

The first fixed board 2 is fixedly attached by adhesion or lamination to the top surface 32 of the housing 30. The first moving board 4 is mounted so that the first moving board is biased toward the first fixed board 2 and thereby its first conductive strips 12*a* (FIG. 4) are sufficiently in line-contact with the first circuit pattern 6 to ensure conductivity therebetween.

The phase shifter 1 according to some embodiments includes a guide unit 100 for guiding movement of the first moving board 4 and/or the second moving board 5. In some embodiments of the present disclosure, the guide unit 100 includes the side wall guide 102, a guide roller 104, and the recessed groove 8 formed in the first fixed board 2 and/or the second fixed board 3. In addition, three side wall guides 102 may be provided at a predetermined pitch along both lateral sides of the housing 30, respectively.

The guide unit 100 has the similar guide roller 104 installed at its underside, and therefore when the pair of guide rollers 104 rotates, the upper first moving board 4 and the lower second moving board 5 slidably moves on the corresponding first fixed board 2 and the second fixed board 3 so as to establish a variable capacitive coupling relationship with the first circuit pattern 6 and a second circuit pattern so that the phase-shifted signal is simultaneously transmitted to the output ports of the first circuit pattern 6 and the second circuit pattern.

As described above, some embodiments of the present disclosure effect generating phase-shifted signals by the first shifting unit 10 and the second shifting unit 20 provided on both surfaces of the housing 30. This reduces the number of phase shifters in a multi-band antenna which needs to individually adjust the phases of multi-band frequencies.

This will be explained referring to FIG. 7, based on the overall operation diagram of phase shifters mounted on antenna panels.

Figure 7:
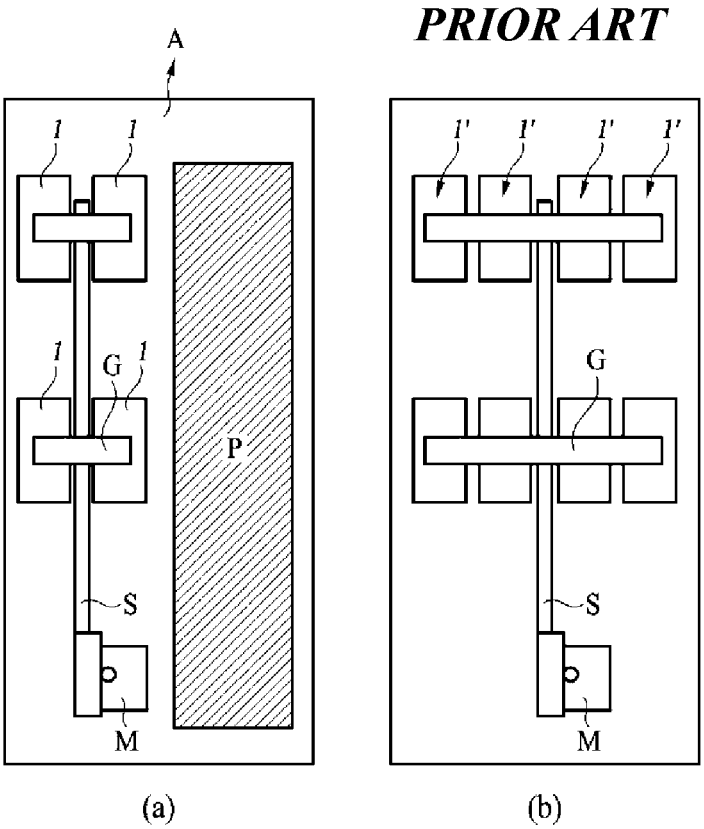
FIG. 7 is operation diagrams of the phase shifter of at least some embodiments and the conventional phase shifter.

FIG. 7 shows at (a) the operation of an antenna panel A as viewed from the back on which the phase shifters 1 according to some embodiments and a drive unit are installed, where the phase shifters 1 are connected to two upper and lower guides G which are linked to a shaft S of an actuator vertically driven by a drive motor M. A total of four phase shifters 1 are arranged, one set of two on each side of the upper and lower guides G. Therefore, the first shifting units and the second shifting units are installed in a total of eight.

When the drive motor M rotates in one direction, the first moving board 4 and the second moving board 5 installed respectively in the first shifting unit 10 and the second shifting unit 20 of each of four phase shifter 1 are respectively brought into contact with or coupled to their first fixed board 2 and second fixed board 3 electrically, while the moving boards are slidably guided by the guide unit 100, whereby the phase-shifted signal is transmitted to the output ports. Conversely, when drive motor M rotates in the reverse direction, the first moving board 4 in the first shifting unit 10 and the second moving board 5 in the second shifting unit 20 of each of four phase shifters 1 are respectively brought into contact with or coupled to their first fixed board 2 and second fixed board 3 electrically, while the moving boards are slidably guided in the opposite direction, whereby the opposite phase-shifted signal is transmitted to the output ports. As shown in FIG. 7 at (b), the conventional phase shifting device 1' of the prior art, which has its single side formed with fixed and moving boards, can match the same effect as the phase shifter 1 according to some embodiments of the present disclosure only with a total of eight phase-shifting devices 1', four being installed in parallel on each of the upper and lower guides G through shaft S. This not only imposes a burden on the output of the drive mechanism including the drive motor M but also fails to solve the space restriction issue due to the phase shifting devices occupying most of the area of the antenna panel A.

The phase shifter 1 according to some embodiments of the present disclosure allows, as shown at (a) in FIG. 7, most of the right side space P to be effectively utilized with a projected effect of saving about 50% of the space of the existing design. Furthermore, the present disclosure can reduce the footprint of the phase shifters to half. This provides an advantage in terms of size and weight reductions of the antenna device.

In addition, the saved space may be converted into a usable space for placing other phase shifters 1 or antenna members or other purposes, to substantially contribute to compactness of the antenna device.

Hereinafter, the guide unit 100 of the phase shifter 1 according to some embodiments of the present disclosure will be described with reference to FIGS. 8 and 9.

Figure 8:
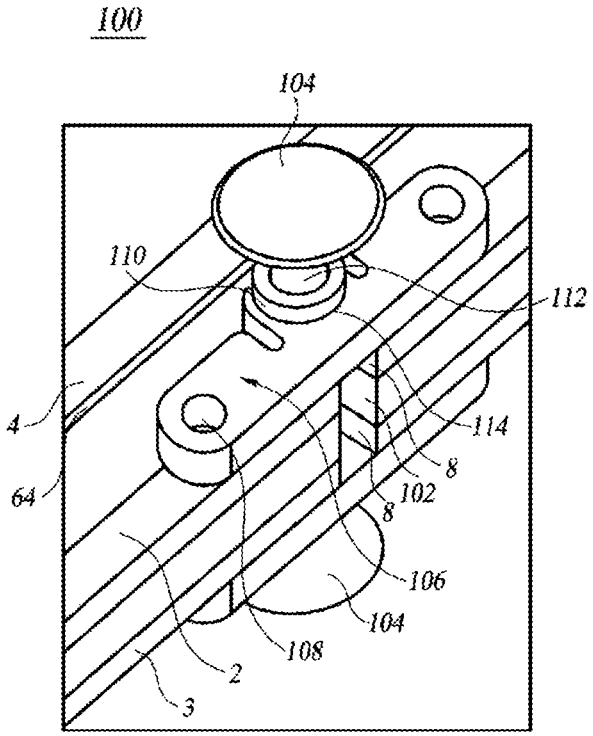
FIG. 8 is an enlarged perspective view of a guide unit of the phase shifter of at least some embodiments.
Figure 9:
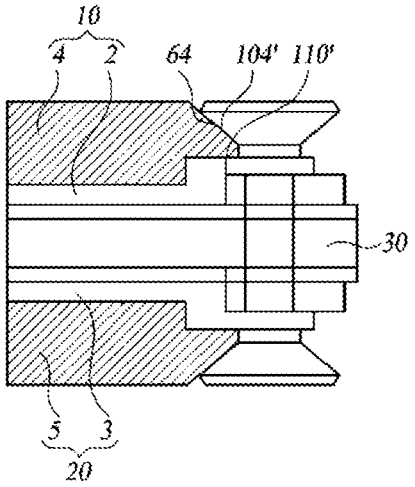
FIG. 9 is a cross-sectional view taken along line a-a' of FIG. 6.

FIG. 8 is an enlarged perspective view of the guide unit 100 of FIG. 6, and FIG. 9 is a cross-sectional view taken along line a-a' of FIG. 6. The guide unit 100 has two identical mounting structures on the top and bottom surfaces of the housing 30 (FIG. 9), and the following description is provided with reference to the top mounting structure.

The guide unit 100 according to some embodiments of the present disclosure has a structure in which a pair of upper and lower guide rollers 104 are each fastened to a horizontal bracket 106. The horizontal bracket 106 may have holes 108 formed on both sides, through which fastening members such as bolts or pins penetrate to fix the horizontal bracket 106 to the top surface of the first fixed board 2.

The horizontal bracket 106 has a central groove 114. The guide roller 104 has a rotating shaft 112 which penetrates the central groove 114 of the horizontal bracket 106, the recessed groove 8 of the first fixed board 2, and the side wall guide 102 (FIG. 6) of the housing 30, and further extends through the opposite horizontal bracket 106 of the same structure to the opposite guide roller 104. Therefore, the paired guide rollers 104 facing each other with the rotating shaft 112 therebetween are rotated at the same time. The guide roller 104 and the rotating shaft 112 are integrally fabricated as a single part in some embodiments.

To support the rotation of the guide roller 104, a support member 110 such as a washer is inserted on the upper surface of the central groove 114. The washer 110 is a component that accommodates the rotation of the guide roller 104 like a bearing.

As shown in FIGS. 8 and 9, the inclined surface 64 of the first moving board 4 is inserted between an upper surface 110' of the support member 110 (FIG. 8) and a guide surface 104' of the guide roller 104 (FIG. 8). The inclined surface 64 positively makes a line contact with the upper surface 110' and the guide surface 104' so that the guide unit 100 (FIG. 8) smoothly guides the first moving board 4 when the latter starts to be retracted or pulled by the drive motor M (in FIG. 7). Line contact has the advantage of minimizing the contact area of the first moving board 4 with the guide unit 100 by the inclined surface 64.

As described above, according to the guide unit 100 of some embodiments of the present disclosure, the movement of the first moving board 4 is guided by the rotation of the guide rollers 104, resulting in smooth movement of the first moving board 4.

In order to simultaneously guide the movement of the upper and lower moving boards 4 of the first shifting unit 10 and the second shifting unit 20, the guide rollers 104 are employed in the advantageous arrangement by the embodiments of the present disclosure.

Further, the guide roller 104 and the first moving board 4 are brought into slidingly contact with each other, resulting in less wear on the components and improved durability as compared with the conventional compressive fastening technique.

The above illustration highlights the operation of the guide unit 100 against the first fixed board 2 and the first moving board 4 of the first shifting unit 10, and their structural relationship. The phase shifters 1 according to some embodiments of the present disclosure may be configured to have planar symmetry, wherein the operation of the guide unit 100 against the second shifting unit 20 and their structural relationship can be the same as or similar to those of the guide unit 100 against the first shifting unit 10.

Figure 10:
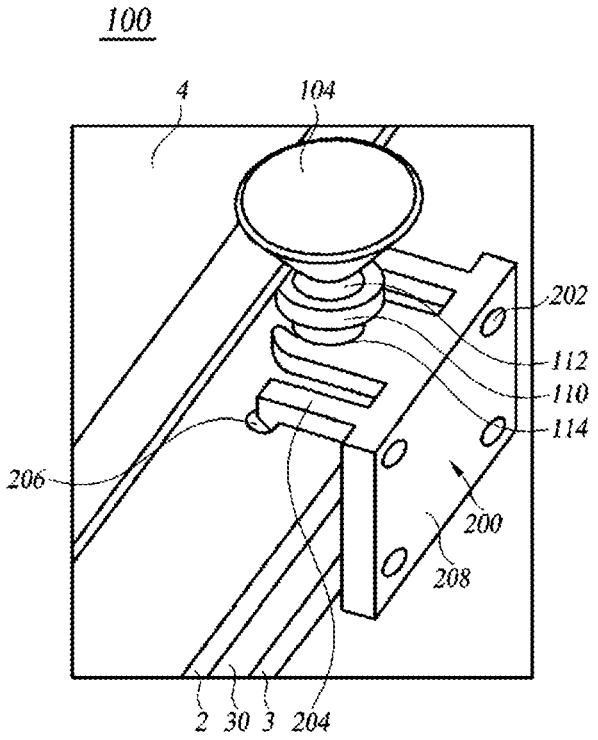
FIG. 10 is an enlarged perspective view of a guide unit of a phase shifter according to another embodiment.

FIG. 10 is an enlarged perspective view of a guide unit 100 of a phase shifter according to another embodiment of the present disclosure.

The difference from the guide unit 100 of FIG. 8 is the use of a vertical bracket 200 with the arrangement of the guide roller 104, the rotating shaft 112 and the central groove 114 remaining the same.

The guide unit 100 includes a vertical bracket 200 having a body 208 formed, at the corners thereof, with four fastening holes 202 through which bolts or pins penetrate to affix the vertical bracket 200 to a side surface of the first fixed board 2. The body 208 is desirably fabricated to have a height that accommodates both the first shifting unit 10 (FIG. 9) and the second shifting unit 20 (FIG. 9), which will then provide a strong supporting force against the phase shifter 1 (FIG. 6) in its height or thickness direction. On the other hand, it can be understood that the horizontal bracket 106 of FIG. 8 provides a relatively strong supporting force in the length direction of the phase shifter 1.

The body 208 of the vertical bracket 200 has support arms 204 on both sides thereof, extending internally, i.e., toward the first fixed board 2 and the second fixed board 3, and the support arms 204 have distal ends each formed with a hooking projection or catch. Correspondingly, slots 206 are formed on the top surface of the first fixed board 2 and the bottom surface of the second fixed board 3, respectively, so that the catches are inserted into the slots 206, to reinforce the fastening of the body 208 to the first fixed board 2 and the second fixed board 3.

Although the embodiments of the guide unit 100 of the present disclosure have been described above, the shape, position, size and number of each member may be appropriately changed. Further, although the guide roller 104 has been highlighted, it is a matter of course that a guide unit of any structure may be employed to effect simultaneous movement of the first and second shifting units.

In addition to simultaneously moving the first shifting unit 10 and the second shifting unit 20, one of the shifting units may be selectively moved. In this case, the rotating shaft 112 of the pair of upper and lower guide rollers 104 may be divided so that the operations of the guide rollers 104 do not cooperate with each other, or the guide unit 100 may be installed on either the top surface or the bottom surface of the phase shifter 1.

The embodiments of the present disclosure described above are not intended to limit the technical idea of the present disclosure, but are for the purpose of illustration only, and the scope of the present disclosure is not limited by the presented embodiments. The interpreted scope of the present disclosure should be the scope of the following claims, and all technical ideas equivalent to or admittedly equivalent to the claims are to be interpreted as being included in the scope of the present disclosure.

The invention claimed is:

1. A phase shifter, comprising:

a housing having a first surface and a second surface;

a first shifting unit configured to be disposed on the first surface of the housing, and to comprise:

a first fixed board formed with a first circuit pattern, a first moving board formed with a first conductive strip that is coupled to the first circuit pattern of the first fixed unit; and a second shifting unit configured to be disposed on the second surface of the housing, and to comprise:

a second fixed board formed with a second circuit pattern, and a second moving board formed with a second conductive strip that is coupled to the second circuit pattern of the second fixed unit; and a guide unit configured to guide movement of the first moving board of the first shifting unit and/or the second moving board of the second shifting unit, wherein the guide unit comprises a guide roller rotatable about a rotation axis perpendicular to a moving direction of the first moving board and the second moving board.

2. A communication apparatus, comprising the phase shifter according to claim 1.

3. An antenna device, comprising:

the phase shifter according to claim 1;

an actuator configured to linearly move the guide unit; and a driving source configured to drive the actuator.

4. A phase shifter, comprising:

a housing comprising a planar body, wherein the planar body has a first surface, a second surface and two ends;

a first shifting unit configured to be disposed on the first surface of the housing, and comprises:

a first fixed board formed with a first circuit pattern, and a first moving board formed with a first conductive strip that is coupled to the first circuit pattern of the first fixed circuit;

a second shifting unit configured to be disposed on the second surface of the housing, and comprises:

a second fixed board formed with a second circuit pattern, and a second moving board formed with a second conductive strip that is coupled to the second circuit pattern of the second fixed unit, wherein the housing further comprises:

a pair of side walls standing upright from the two ends of the planar body such that the planar body and the pair of side walls constitute an H-shaped frame whose top and bottom are open, and wherein the housing comprises a first groove for accommodating the first fixed board and a second groove for accommodating the second fixed board.

5. The phase shifter of claim 4, wherein the housing is made of an alloy containing aluminum, boron, quartz or vitreous quartz or ceramics or plastics or mixtures thereof, which have good heat resistance to accommodate heat radiation of the first fixed board and the second fixed board.

6. A phase shifter, comprising:

a housing having a first surface and a second surface;

a first shifting unit configured to be disposed on the first surface of the housing, and comprises:

a first fixed board formed with a first circuit pattern, and a first moving board formed with a first conductive strip that is coupled to the first circuit pattern of the first fixed circuit;

a second shifting unit configured to be disposed on the second surface of the housing, and comprises:

a second fixed board formed with a second circuit pattern, and a second moving board formed with a second conductive strip that is coupled to the second circuit pattern of the second fixed unit, and a guide unit configured to guide movement of the first moving board of the first shifting unit and/or the second moving board of the second shifting unit, wherein the guide unit comprises:

at least one side wall guide formed on a side wall of the housing;

at least one recessed groove formed on a side surface of the first fixed board and/or the second fixed board; and at least one guide roller configured to guide the first moving board and/or the second moving board to move with respect to the first fixed board and/or the second fixed board.

7. The phase shifter of claim 6, wherein the at least one guide roller comprises two guide rollers for guiding the first moving board and/or the second moving board, and the two guide rollers are interconnected by a rotating shaft extending through the at least one recessed groove and the at least one side wall guide.

8. The phase shifter of claim 7, wherein the guide unit further includes at least one bracket fixed to the first fixed board and the second fixed board, and the rotating shaft extends passing through a central groove of the at least one bracket, the at least one recessed groove, and the at least one side wall guide.

9. The phase shifter of claim 8, further comprising a support member configured to be inserted into a first upper surface of the at least one bracket above the central groove to support rotation of the at least one guide roller.

10. The phase shifter of claim 9, wherein the support member has a second upper surface, the at least one guide roller has a guide surface, each of the first moving board and the second moving board has a respective lateral side, and each of the first moving board and the second moving board has a respective inclined surface formed on the corresponding lateral side, and wherein the respective inclined surface of the first moving board and/or the second moving board is inserted between the second upper surface of the support member and the guide surface of the at least one guide roller so that the respective inclined surface makes a line contact with the second upper surface and the guide surface, so as to minimize a contact area between the respective inclined surface and the guide unit.

11. The phase shifter of claim 8, wherein the at least one bracket comprises:

at least one horizontal bracket configured to be fixed to at least one top surface of the first fixed board and/or the second fixed board via a respective fastening member; or a vertical bracket configured to be fixed to at least one side surface of the first fixed board and/or the second fixed board via the respective fastening member, and to have a corresponding height that accommodates the first shifting unit and/or the second shifting unit.

* * * * *